US007008488B2

(12) United States Patent
Akamizu et al.

(10) Patent No.: US 7,008,488 B2
(45) Date of Patent: Mar. 7, 2006

(54) HIGH-STRENGTH STEEL SHEET HAVING EXCELLENT WORKABILITY AND PRODUCTION PROCESS THEREFOR

(75) Inventors: Hiroshi Akamizu, Kobe (JP); Shushi Ikeda, Kobe (JP); Koichi Makii, Kobe (JP)

(73) Assignee: Kabushiki Kaisha Kobe Seiko Sho (Kobe Steel, Ltd.), Kobe (JP)

( * ) Notice: Subject to any disclaimer, the term of this patent is extended or adjusted under 35 U.S.C. 154(b) by 222 days.

(21) Appl. No.: 10/614,821

(22) Filed: Jul. 9, 2003

(65) Prior Publication Data

US 2004/0007298 A1 Jan. 15, 2004

(30) Foreign Application Priority Data

Jul. 12, 2002 (JP) ..... 2002-204168

(51) Int. Cl.
*C22C 38/02* (2006.01)
*C22C 38/04* (2006.01)
*C21D 8/02* (2006.01)

(52) U.S. Cl. ..... 148/320; 148/663; 148/650; 148/651; 148/654

(58) Field of Classification Search ..... 148/320, 148/651, 652, 653, 654, 650, 663
See application file for complete search history.

(56) References Cited

U.S. PATENT DOCUMENTS 6,280,538 B1 8/2001 Soshiroda et al.
6,306,527 B1 10/2001 Ikeda et al.

FOREIGN PATENT DOCUMENTS

| | | |
|---|---|---|
| EP | 0 922 782 | 6/1999 |
| EP | 0 952 235 | 10/1999 |
| EP | 1 201 780 | 5/2002 |
| JP | 2-97620 | 4/1990 |
| JP | 404337026 | * 11/1992 |
| JP | 5-255799 | 10/1993 |
| JP | 406065677 | * 3/1994 |
| JP | 411323490 | * 11/1999 |
| JP | 2000-212647 | 8/2000 |

OTHER PUBLICATIONS

U.S. Appl. No. 10/928,176, filed Aug. 30, 2004, Kashima at al.

(Continued)

*Primary Examiner*—Deborah Yee
(74) *Attorney, Agent, or Firm*—Oblon, Spivak, McClelland, Maier & Neustadt, P.C.

(57) ABSTRACT

A high-strength steel sheet comprises carbon: 0.06 to 0.25 mass %, Si: 0.5 to 3.5 mass % and Mn: 0.7 to 4 mass %. Its mother structure is ferrite, its second phase structure comprises martensite and the residual austenite and the second phase structure measured by image analysis has an area fraction of 25% or less based on the total structure. The steel sheet satisfies the following requirements (1) to (3): (1) the volume fraction (Vtγhd R) of the residual austenite is 5% or more; (2) the ratio ($SF\gamma_R/Vt\gamma_R$) of the area fraction ($SF\gamma_R$) of the residual austenite within ferrite to $Vt\gamma_R$ is 0.65 or more; and (3) the ratio [$\alpha 2/(\alpha 1+\gamma_R)$] of the space factor ($\alpha 2$) of martensite to the second phase structure ($\alpha 1+\gamma_R$) is 0.25 to 0.60. The steel sheet has excellent balance between strength and local elongation, and a low yield ratio.

6 Claims, 2 Drawing Sheets

OTHER PUBLICATIONS

U.S. Appl. No. 10/614,821, filed Jul. 9, 2003, Akamizu et al.
U.S. Appl. No. 10/785,080, filed Feb. 25, 2004, Ikeda et al.
U.S. Appl. No. 11/030,100, filed Jan. 7, 2005, Akamizu et al.
U.S. Appl. No. 11/044,185, filed Jan. 28, 2005, Ikeda et al.
U.S. Appl. No. 11/110,716, filed Apr. 21, 2005, Ikeda et al.
U.S. Appl. No. 10/614,821, Jul. 9, 2003, Akamizu et al.

* cited by examiner

HIGH-STRENGTH STEEL SHEET HAVING EXCELLENT WORKABILITY AND PRODUCTION PROCESS THEREFOR

BACKGROUND OF THE INVENTION

1. Field of the Invention

The present invention relates to a high-strength steel sheet having excellent workability and, specifically, to a high-strength steel sheet which is excellent in balance between strength and total elongation (especially local elongation in the latter stage of transformation out of total elongation) and has a low yield ratio. More specifically, there is provided a steel sheet which satisfies strength [TS (MPa)]×local elongation [l-EL (%)]≧5500, ratio [(l-EL)/(t-EL)] of local elongation to total elongation [t-EL (%)]≧0.25, and yield ratio (YR)≦65%.

2. Description of the Related Art

Demand for high-strength steel sheets is growing, mainly backed by efforts to reduce fuel cost by reducing the weight of a steel sheet for automobiles and ensure safety at the time of a collision. That demand is further growing from the viewpoint of the preservation of the global environment.

However, moldability is strongly desired even for high-strength steel sheets and it is important to select and use a high-strength steel sheet having suitable moldability according to application purpose. Particularly in application fields in which steel sheets are pressed to a complex shape, the provision of a high-strength steel sheet which has both stretch-formability (ductility) and stretch-flange properties (hole expandability (local ductility)) (that is, low yield ratio) and good balance between strength and local elongation is earnestly desired.

As a high-strength thin steel sheet which has been developed to meet the above need is known the residual austenite steel sheet in which the residual austenite is formed in the structure and ductility is improved by the induction transformation (transformation-induced plasticity: TRIP) of YR during processing deformation. For example, Japanese Laid-open Patent Application No. 2-97620 discloses a TRIP composite structure steel (PF steel) composed of a mixed structure of ferrite, bainite and the residual austenite. According to the above publication, the steel is produced by heating at a bainite transformation temperature range and maintaining that temperature for a predetermined time (so-called austempering). Therefore, C having a large dispersion constant is concentrated in untransformed austenite and stabilized to cause austenite to remain without transforming it into martensite at room temperature, thereby obtaining a high-strength steel sheet having excellent workability. However, nowadays when importance is attached to both ductility and workability, further improvement of ductility (especially local elongation) is strongly desired.

Japanese Laid-open Patent Application No. 5-255799 discloses a steel sheet which contains one or more out of bainite, martensite and the residual austenite and ferrite and its local ductility is much higher than a conventional TRIP steel sheet. However, when the yield ratio of Example is calculated, it is 78% or more which means the steel sheet is inferior in stretch-formability. The reason for this seems to be that the amount of the formed martensite and the like useful for the reduction of yield ratio greatly decreases because the top priority is placed on the improvement of ductility (especially local elongation) in the above steel sheet.

SUMMARY OF THE INVENTION

It is an object of the present invention which has been made in view of the above situation to provide a high-strength steel sheet which has good balance between strength and local elongation and a low yield ratio and a process for producing this high-strength steel sheet efficiently.

A high-strength steel sheet having excellent workability according to the present invention which can solve the above problem comprises 0.06 to 0.25% (mass %, % of the following components means mass %) of C, 0.5 to 3.5% of Si and 0.7 to 4% of Mn. Its mother phase structure is ferrite, its second phase structure comprises martensite and the residual austenite, and the second phase structure ($\alpha 1+\gamma_R$) has an area fraction of 25% or less based on the total structure when it is measured by image analysis. Further, the steel sheet satisfies the following requirements (1) to (3) (may be referred to as "first steel sheet" hereinafter) or the following requirements (1), (4) and (3) (may be referred to as "second steel sheet" hereinafter).

[First Steel Sheet]

(1) the residual austenite ($Vt\gamma_R$) has a volume fraction of 5% or more when a measurement specimen is measured by saturation magnetization measurement, (2) the ratio ($SF\gamma_R/Vt\gamma_R$) of the area fraction ($SF\gamma_R$) of the residual austenite within the ferrite particle to the above $Vt\gamma_R$ is 0.65 or more when the area fraction is measured by FE-SEM/EBSP, and (3) the ratio [$\alpha 2/(\alpha 1+\gamma_R)$] of the space factor ($\alpha 2$) of martensite to the above second phase structure ($\alpha 1+\gamma_R$) satisfies the following expression:

$$0.25 \leqq [\alpha 2/(\alpha 1+\gamma_R)] \leqq 0.60,$$

wherein the space factor ($\alpha 2$) is calculated from a difference between the above second phase structure ($\alpha 1+\gamma_R$) and the residual austenite ($Vt\gamma_R$).

[Second Steel Sheet]

(1) The same as the first steel sheet, (4) the average content of C in the above residual austenite is 0.95 to 1.2% by mass, (3) the same as the first steel sheet.

The steel sheet can further comprise preferably 2% or less (not including 0%) of Ni and/or 2% or less (not including 0%) of Cu. The steel sheet can further comprise preferably 1.0% or less (not including 0%) of Cr and/or 1.0% or less (not including 0%) of Mo. The steel sheet can further comprise preferably 0.3% or less (not including 0%) of P. The steel sheet can further comprise preferably 2.0% or less (not including 0%) of Al. The steel sheet can further comprise preferably 0.1% or less (not including 0%) of at least one selected from the group consisting of Ti, Nb and V.

The process for producing the steel sheet of the present invention which solves the above problem is a process for producing a high-strength steel sheet by hot rolling, optionally cold rolling and continuous annealing according to the present invention, which comprises the steps of subjecting a slab containing the above components to solution treatment at 1,270° C. or higher for 5 hours or more before hot rolling, hot rolling the slab into a steel sheet and subjecting the steel sheet to austempering to be wound up after the hot rolled steel sheet is cooled to a bainite transformation range and maintained at that temperature range for 50 to 200 seconds.

Since the present invention is constituted as described above, there can be provided a high-strength steel sheet which has good balance between strength and local elongation and a low yield ratio and a process for producing this high-strength steel sheet efficiently.

DESCRIPTION OF THE PREFERRED EMBODIMENTS

Figure 1:
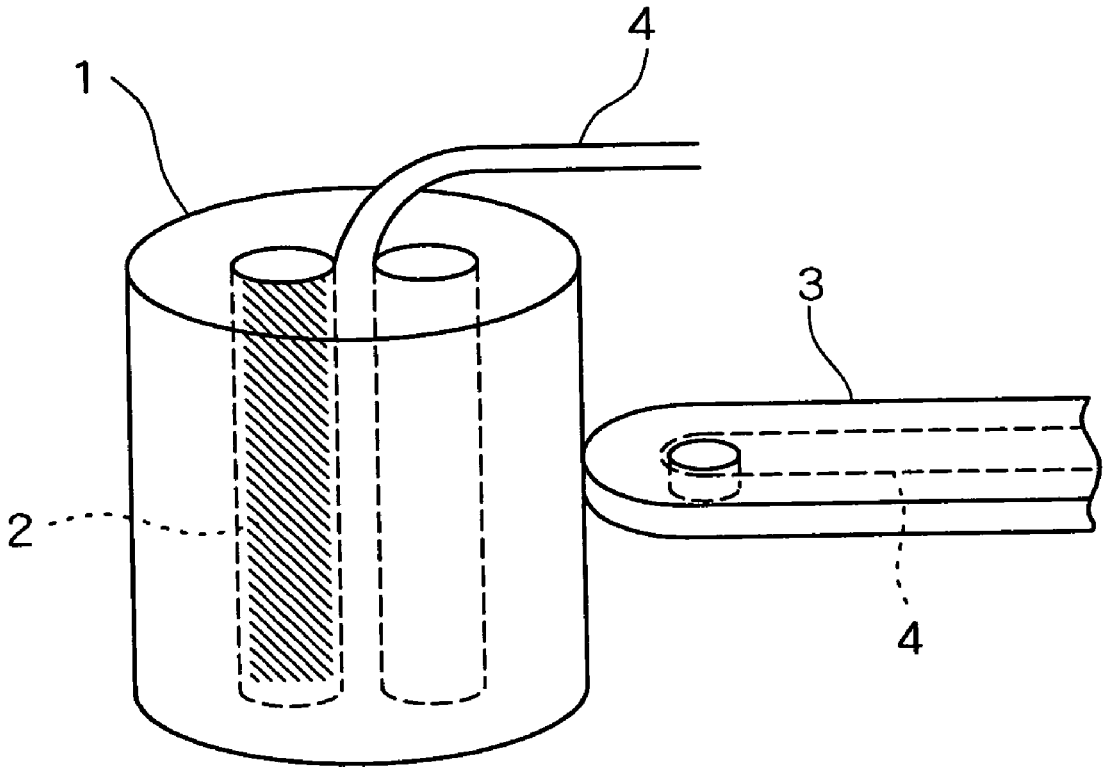
FIG. 1 is a partial perspective view of an apparatus used for saturation magnetization measurement.

The inventors of the present invention have conducted intensive studies to provide a TRIP steel sheet having "high ductility (especially excellent local elongation)" and "high moldability (low yield ratio)" which have been considered difficult to be obtained at the same time for a conventional TRIP steel sheet, paying special attention to the residual austenite ($\gamma_R$). As a result, they have found that a high-strength steel sheet having both of the above properties is obtained by carrying out solution treatment and suitably carrying out austempering. Solution treatment has not been employed to produce a TRIP steel sheet because it takes a long time before hot rolling. More specifically, they have found that, due to the above treatments, (1) $\gamma_R$ having small differences in the concentration distribution of C can be formed stably in an arbitrary portion at the grain boundary of ferrite or within the ferrite particle, (2) $\gamma_R$ which contributes to the improvement of ductility, martensite which contributes to the improvement of moldability (reduction of yield ratio) and instable $\gamma_R$ which readily transforms into martensite can be thereby deposited in a well-balanced manner, and (3) a large amount of $\gamma_R$ which contributes to the improvement of local elongation in the latter stage of transformation is formed within the ferrite particle when the amount of $\gamma_R$ in the steel sheet is measured. Interestingly, they have also found that the average value of C content ($C\gamma_R$) in $\gamma_R$ in the steel sheet of the present invention is controlled to a very narrow range of 0.95 to 1.2% and $\gamma_R$ in the steel sheet of the present invention differs from $\gamma_R$ in the TRIP steel sheet having excellent ductility of the prior arts in the position of its existence and the concentration distribution of C. Thus, the present invention has been accomplished. "$\gamma_R$ which is existent within the ferrite particle in large quantities, retains a high C content and has small differences in the concentration distribution of C" may be specially referred to as "relatively stable $\gamma_R$".

A detailed description is given of the basic concept (basic idea) of the steel sheet of the present invention together with circumstances for attaining the present invention.

As for "ductility (especially local elongation)" which is one of the requirements in the present invention, it is generally considered that YR controls ductility in the structure of a TRIP steel sheet. To further improve ductility, it is said that it is useful to "enhance the stability of $\gamma_R$" by: (1) increasing $C\gamma_R$, (2) making minute $\gamma_R$, or (3) depositing $\gamma_R$ within the ferrite particle. That is, it is said that a steel sheet which satisfies the above (1) to (3) has high stability of $\gamma_R$ and improved ductility. In contrast to this, $\gamma_R$ existent in the grain boundary of ferrite has low $C\gamma_R$ or is coarse, that is, "the stability of $\gamma_R$ is low". Therefore, it is considered to be highly probable that it is existent as martensite at room temperature.

Therefore, to improve ductility, austempering or the like described in the above Japanese Laid-open Patent Application No. 2-97620 is carried out to concentrate C to such an extent much higher than its solubility limit in untransformed austenite to increase $C\gamma_R$, thereby enhancing the stability of $\gamma_R$.

When the present inventors have studied about "$\gamma_R$ having extremely high $C\gamma_R$" obtained by the above method in detail, they have found that the above $\gamma_R$ is mainly existent in the grain boundary of ferrite but rarely existent within the ferrite particle. As $\gamma_R$ existent in the grain boundary of ferrite is very sensitive to distortion, $C\gamma_R$ becomes partially high. However, a large amount of $\gamma_R$ having large differences in the concentration distribution of C is formed in the whole steel sheet.

The cause of forming "$\gamma_R$ having large differences in the concentration distribution of C" is considered to be the central segregation (macrosegregation) of a substituted alloy element (slowly dispersed element in the center portion of the slab) such as Mn. Mn added to steel is useful as an element for forming $\gamma_R$ but has a defect that it is easily segregated by casting. It is extremely difficult to eliminate the central segregation of a substituted alloy element such as Mn by a winding treatment during hot rolling or heat treatment during recrystallization annealing (CAL/CGL). Therefore, it is considered that $\gamma_R$ having large differences in the concentration distribution of C is formed in the grain boundary of ferrite in large quantities and nonuniformly along with the central segregation by coagulation segregation at the time of casting.

As for "moldability (low yield ratio)" which is another requirement in the present invention, it is said that martensite which is existent in the initial stage of transformation or instable $\gamma_R$ which transforms into martensite near a yield point controls moldability. However, in a conventional TRIP steel sheet, martensite and instable $\gamma_R$ useful for reducing the yield ratio are greatly reduced to increase the stability of $\gamma_R$ by enhancing the $C\gamma_R$ content, because importance is attached to the improvement of ductility (especially local elongation). As a result, it was found that the obtained steel sheet has problems with shape freezability, such as a high yield ratio and poor stretch-formability although it has extremely excellent local ductility.

Then, the present inventors have changed their approach and have conducted studies to improve ductility not by forming "$\gamma_R$ having extremely high stability by increasing the $C\gamma_R$ content" as in the prior arts but by maintaining a high $C\gamma_R$ content to obtain a predetermined level of ductility and depositing $\gamma_R$ within the ferrite particle in large quantities, paying attention to the existence site of $\gamma_R$ which was not recognized in the prior arts. Since there is little possibility that crystal misfitting between ferrite matrix and $\gamma_R$ occurs within the ferrite particle during transformation, it is considered that $\gamma_R$ within the ferrite particle can be existent stable to transformation (the above-described "relatively stable $\gamma_R$" is formed) and contributes to local elongation in the latter stage of transformation.

As a result, solution treatment which has not been employed for a conventional TRIP steel sheet is carried out and austempering is suitably carried out so that the central segregation of Mn or the like can be eliminated and an alloy element or the like can be uniformly dispersed. This makes possible the following:

(1) "Relatively stable $\gamma_R$" can be formed in large quantities at a site where there is a relatively large amount of an alloy element within the old $\gamma$ particle; and (2) martensite which contributes to moldability and instable $\gamma_R$ (instable $\gamma_R$ which changes into martensite before transformation or transforms into martensite near a yield point) can be formed in the largest quantities within the range of uniform elongation between the yield point and TS at a site where there is a relatively small amount of an alloy element.

As a result, a TRIP steel sheet which had both excellent ductility and moldability could be successfully provided.

Paying attention to $\gamma_R$ of the steel sheet of the present invention in particular, in the present invention, $\gamma_R$ whose average $C\gamma_R$ content is controlled to a relatively high level of 0.95 to 1.2% and to an extremely narrow range (small differences in the concentration distribution of C) is formed within the ferrite particle in large quantities, which makes the steel sheet of the present invention clearly different from a TRIP steel sheet (TRIP steel sheet having enhanced ductility in particular) of the prior arts. The TRIP steel sheet of the prior arts which attaches importance to the improvement of ductility has an average $C\gamma_R$ content of about 1.2 to 1.3%, which is a relatively high value. However, in the TRIP steel sheet of the prior arts, nonuniform $\gamma_R$ having large differences in the concentration distribution of C is formed particularly in the grain boundary of ferrite in large quantities.

Figure 2:
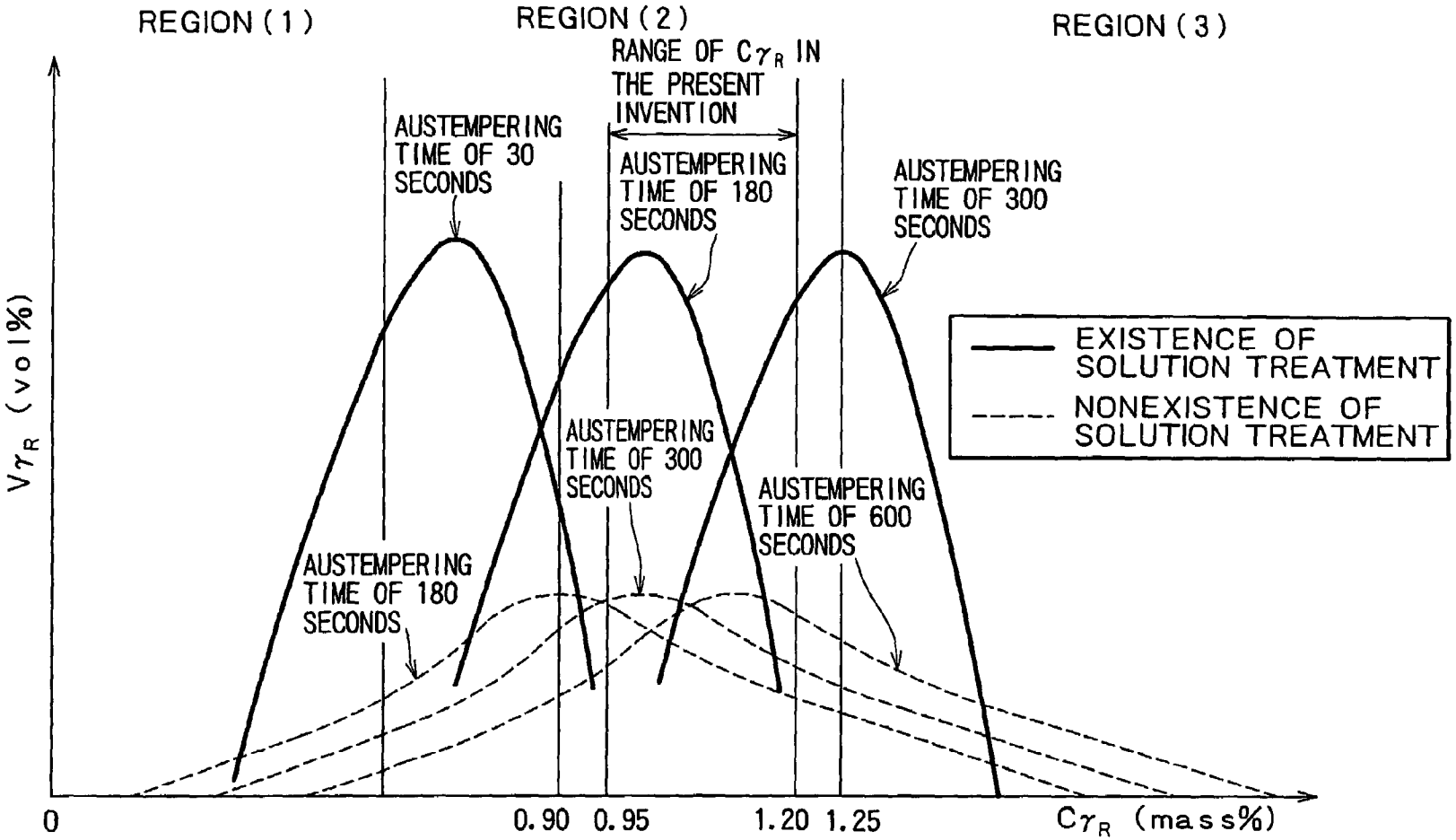
FIG. 2 is a graph showing changes in the C content [$C\gamma_R$ (mass %)] and volume fraction [$V\gamma_R$ (vol %)] of $\gamma_R$ when the existence of solution treatment and the austempering time are changed.

FIG. 2 is a graph showing changes in the C content [$C\gamma_R$ (mass %)] and volume fraction [$V\gamma_R$ (vol %)] of $\gamma_R$ based on the results of Examples to be described hereinafter according to the existence of solution treatment and when the austemper time is changed. In FIG. 2, $V\gamma_R$ signifies the volume fraction (amount of $\gamma_R$ existent within the ferrite particle) of $\gamma_R$ calculated by a saturation magnetization measurement method described in (2) above.

In FIG. 2, the region (1) is a region where "$\gamma_R$ has low stability" and is very likely to be existent as martensite at room temperature, the region (2) is a region where "$\gamma_R$ is existent relatively stably", and the region (3) is a region where "$\gamma_R$ has high stability".

The curves shown by dot lines show hot rolled steel sheets of the prior arts obtained by changing the austempering time to 180, 300 and 600 seconds without solution treatment. As the austempering time is prolonged, $C\gamma_R$ becomes higher. However, since the steel sheets of the prior arts are not subjected to solution treatment, in either case, nonuniform $\gamma_R$ having large differences in the concentration distribution of C is formed and the amount of $\gamma_R$ existent within the ferrite particle remains unchanged and small. For instance, when the austempering time is 180 seconds, the average value of $C\gamma_R$ is 0.90% which is below the lower limit (0.95%) of the present invention. When the austempering time is 600 seconds, the average value of $C\gamma_R$ satisfies the range (0.95 to 1.2%) of the present invention, but the region where $\gamma_R$ has high stability increases and the region where $\gamma_R$ has low stability decreases, whereby $\gamma_R$ becomes high and desired characteristic properties are not obtained.

In contrast to this, the curves shown by solid lines are hot rolled steel sheets obtained by carrying out solution treatment and changing the austempering time to 30, 180 and 300 seconds. There is a tendency that "when the austempering time is prolonged, $C\gamma_R$ becomes higher" like the hot rolled steel sheets of the prior arts. However, since the steel sheets are subjected to solution treatment, the differences in the concentration distribution of C are small and the amount of $\gamma_R$ existent within the ferrite particle greatly increases. However, when the austempering time is short at 30 seconds, desired $C\gamma_R$ is not obtained and when the austempering time is long at 300 seconds, $C\gamma_R$ is 1.25% which is larger than the upper limit value of the present invention. When the austempering time is 180 seconds, desired $C\gamma_R$ is obtained, whereby the targeted characteristic properties of the present invention can be ensured (relationship with the characteristic properties will be detailed in Example).

The basic idea for obtaining the steel sheet of the present invention has been described above. The requirements for characterizing the present invention will be described next.

A description is first given of the structure for characterizing the present invention.

As described above, in the steel sheet of the present invention, its mother phase structure has ferrite, its second phase structure has martensite and the residual austenite, and the second phase structure ($\alpha 1+\gamma_R$) measured by image analysis has an area fraction of 25% or less based on the total structure.

Mother Phase Structure: Ferrite

The "ferrite" in the present invention refers to polygonal ferrite, that is, ferrite having a low dislocation density. The above ferrite is excellent in ductility such as elongation but inferior in moldability such as stretch-flange properties when it is existent in large quantities. Therefore, it is recommended to suitably control the area fraction of ferrite to the total structure by balance between the ferrite and the second phase structure (martensite and $\gamma_R$) to be described hereinafter so that desired high ductility and high moldability are obtained.

Second Phase Structure: Martensite and $\gamma_R$

In the present invention, out of other structures excluding the above mother phase structure (ferrite), martensite and $\gamma_R$ are defined as the second phase structure. The area fraction of the second phase structure to the total structure must be controlled to 25% or less (preferably 20% or less, more preferably 15% or less) so that desired characteristic properties are exhibited from the relationship with the above mother phase structure. When the area fraction of the above second phase structure is higher than 25%, the amount of the ferrite as the mother phase structure becomes small and hard martensite is formed, thereby making it difficult to ensure satisfactory elongation.

The area fraction of the above second phase structure is obtained by image analysis at a position which is about t/4 of the steel material.

More specifically, the steel sheet is corroded by a Lepera etching method and observed through an optical microscope (X1000), and a plane parallel to the rolled surface is photographed at the position (t/4 position) which is about ¼ the thickness of the plate. The area fraction of the second phase structure is measured using commercially available image software "NanoHunter NS2K-Lt general-purpose image processing software" (of Nanosystems Co., Ltd.) by tracing the white corroded second phase structure in the above photo.

The steel sheet of the present invention is substantially composed of ferrite as the mother-phase structure and martensite and $\gamma_R$ as the second phase structure. It may contain also a different structure (bainite) in limits that do not impair the function of the present invention. Bainite may remain inevitably in the production process of the present invention. When the area fraction of bainite is about 10% or less based on the total structure, it does not impede the function of the present invention. Therefore, a steel sheet containing bainite in that amount is included in the scope of the present invention.

A description is subsequently given of the requirements (1) to (4) for characterizing the present invention the most. These requirements specify the amount, space factor and C content of $\gamma_R$ in the second phase structure and the space factor of martensite to obtain desired characteristic properties effectively in the present invention which is aimed to provide a high-strength steel sheet having ductility and moldability. In the present invention, what satisfies the following requirements (1), (2) and (3) is called "first steel sheet" and what satisfies the following requirements (1), (4) and (3) is called "second steel sheet" for convenience's sake. The both steel sheets differ from each other only in $\gamma_R$ for characterizing the present invention the most. The first steel sheet which has the requirement (2) for specifying the ratio of $\gamma_R$ existent within the ferrite particle and the second steel sheet which has the requirement (4) for specifying the average C content ($C\gamma_R$) of $\gamma_R$.

A description is first given of the requirements [(1), (2), (4)] for $\gamma_R$.

$$(1)\ Vt\gamma_R\ (\%) \geqq 5 \tag{1}$$

In the above expression (1), $Vt\gamma_R$ is a $\gamma_R$ (vol %) obtained when a measurement specimen is measured by saturation magnetization measurement.

The above expression (1) specifies the amount of $\gamma_R$ for exhibiting the function of $\gamma_R$ which contributes to the improvement of ductility effectively by a saturation magnetization measurement method.

The method of measuring $\gamma_R$ by saturation magnetization measurement will now be described. This method is obtained by further improving the sensitivity of a saturation magnetization measurement method which is known as a amount determination method having higher accuracy than X-ray diffraction. As for details, refer to Japanese Laid-open Patent Application No. 2001-285750.

Stated more specifically, the saturation magnetization amount (I) of a measurement specimen (test specimen measuring 3.6 mm (thickness)×4 mm (width)×30 mm (length)) having a certain shape and the saturation magnetization amount (Is) of a measurement specimen which comprises substantially the same components as the measurement specimen and has a volume fraction of $\gamma_R$ of 0% are obtained by actual measurement or calculation so as to calculate the amount of $\gamma_R$ in the measurement specimen based on the following equation (A).

$$\gamma_R\ (\text{vol}\ \%) = (1 - I/Is) \times 100 \tag{A}$$

As for details, the apparatus shown in FIG. 1 was used, the gap between electrodes was 30 mm, application magnetization at room temperature was carried out at 5,000 to 10,000 Oe (oersted), and the both-pole maximum magnetization average value of a hysteresis loop was taken as saturation magnetization amount. Since the above saturation magnetization amount is easily influenced by variations in measurement temperature, when it is measured at room temperature, it is preferably measured at 23° C.±3° C.

To obtain Is by actual measurement, the specimen used for the measurement of Is is preferably (1) a specimen obtained by subjecting steel having substantially the same components as the measurement specimen to austempering for a long time or strong cold processing. Alternatively, it is (2) a specimen obtained by subjecting a steel material which differs from the measurement specimen but comprises substantially the same components as the measurement specimen to austempering for a long time or strong cold processing. Or a specimen obtained by subjecting the measurement specimen measured for the amount of saturation magnetization (I) to the above austempering for a long time or strong cold processing may be used as an Is measurement specimen.

The residual austenite ($Vt\gamma_R$) measured as described above is extremely useful because the amount of $\gamma_R$ existent in the measurement specimen (3.6 (thickness)×4 mm (width)×30 mm (length)) can be accurately determined. The difference between the FE-SEM/EBSP (Electron BackScatter diffraction Pattern) method described in the expression (2) to be described hereinafter and the above saturation magnetization measurement method will be described next.

In the FE-SEM/EBSP method, the crystal structure and crystal direction can be specified by analyzing EBSP which appears when an electron beam is irradiated onto a certain point. Although this method has an advantage that the evaluation of a form by mapping can be made by combining an electron microscope such as FE-SEM so that the quantities of $\gamma_R$ existent within the ferrite particle and in the grain boundary of ferrite can be determined independently from each other, it has a disadvantage that $\gamma_R$ within a bulk cannot be measured. As described above, the central segregation of Mn and the like added to steel readily occurs at the time of casting and $\gamma_R$ is easily formed by the segregation, thereby increasing the amount of $\gamma_R$ in the center portion of a steel material. However, since the FE-SEM/EBSP method can determine only the amount of $\gamma_R$ existent in the surface layer portion, it has a problem that $\gamma_R$ existent in the specimen cannot be measured accurately. In contrast to this, the above saturation magnetization measurement method can measure $\gamma_R$ existent in a measurement specimen accurately whether it is existent in the surface layer portion or within a bulk. Therefore, the method can determine the amount of whole $\gamma_R$ including $\gamma_R$ formed within the bulk by central segregation accurately. In addition, the above saturation magnetization measurement method has advantages that operation is easy and highly accurate data on $\gamma_R$ is obtained in a short period of time and at a low cost compared with the FE-SEM/EBSP method. Therefore, in the present invention, excluding a case where the amount of $\gamma_R$ within the ferrite particle is determined, $\gamma_R$ is measured by the above saturation magnetization measurement method.

In the present invention, $Vt\gamma_R$ measured by the above saturation magnetization measurement method is set to 5% or more as an index for ensuring desired ductility. Meanwhile, since elongation flange properties deteriorate when the second phase is existent in large quantities, it is recommended to control it to 20% or less (preferably 15% or less, more preferably 10% or less).

A description is subsequently given of the expression (2) or (4) for characterizing the present invention the most.

$$(2)\ (SF\gamma_R/Vt\gamma_R) \geqq 0.65 \tag{2}$$

In the expression (2), $SF\gamma_R$ is the area fraction of $\gamma_R$ within the ferrite particle measured by FE-SEM/EBSP and $Vt\gamma_R$ is as defined above.

The above expression (2) is determined from the viewpoint that what has a ratio of $\gamma_R$ ($SF\gamma_R$) existent within the ferrite particle to $\gamma_R$ existent in a measurement specimen (test specimen measuring 3.6 (thickness)×4 m (width)×30 mm (length)) of 0.65 or more contributes particularly to the improvement of local elongation in the latter stage of transformation. That is, since $\gamma_R$ existent within the ferrite particle receives the spatial restriction of the ferrite mother phase existent in the surface of the specimen, it has a relatively higher content of C and less differences in the concentration distribution of C than coarse $\gamma_R$ existent in the grain boundary of ferrite. In the present invention, $\gamma_R$ which contributes to the improvement of ductility is called "relatively stable $\gamma_R$" which is specified by the above expression (2) from the viewpoint of the ratio within the ferrite particle.

$\gamma_R$ ($SF\gamma_R$) existent within the ferrite particle is expressed as an fcc phase (face centered cubic lattice) in a mapped region by FE-SEM/EBSP. For the measurement of the above $SF\gamma_R$, the reason for use of FE-SEM/EBSP is that out Of $\gamma_R$ existent in the surface layer portion, the amount of $\gamma_R$ existent within the ferrite particle can be determined independently from $\gamma_R$ existent in the grain boundary of ferrite as described above.

Stated more specifically, high-resolution FE-SEM equipped with an EBSP detector (XL30S-FEG of Philips Co., Ltd.) and the OIM (Orientation Imaging Microscopy™), EBSP-related hardware and software for detection, measurement and analysis of Tecsem Laboratory (TSL) Co., Ltd. were used. For measurement, a measurement specimen was electrolytically polished and its surface layer portion (the most surface portion) was observed immediately (measurement intervals of 0.1 $\mu$m).

The ratio ($SF\gamma_R/Vt\gamma_R$) of $SF\gamma_R$ calculated as described above to $Vt\gamma_R$ obtained from the above expression (1) must be 0.65 or more. When the ratio is lower than 0.65, the amount of $\gamma_R$ existent in the grain boundary of ferrite increases and desired local elongation is not obtained. It is preferably 0.70 or more. The upper limit of the ratio is not particularly limited. As it is higher, more excellent characteristic properties are obtained.

$$(4)\ 0.95 \leqq C\gamma_R \leqq 1.2 \quad (4)$$

In the above expression (4), $C\gamma_R$ is the average content (mass %) of C in $\gamma_R$.

As described above, it is known that as $C\gamma_R$ becomes higher, "highly stable $\gamma_R$" which is useful for the improvement of ductility is obtained. However, since the present invention is aimed to obtain both ductility and moldability, not "highly stable $\gamma_R$" but "relatively stable $\gamma_R$" is formed in order to form a predetermined amount of $\gamma_R$ which readily transforms into martensite which is useful for the improvement of moldability while maintaining $C\gamma_R$ at a high level. The average C content of $\gamma_R$ is specified by the above expression (4). When the average C content is lower than 0.95%, the desired effect of improving ductility is not obtained. When it is higher than 1.2%, desired moldability is not obtained. It is preferably 1.05% or more and 1.2% or less.

The method of measuring the above $C\gamma_R$ is as follows. First, the target is Mo and the lattice constant of r from half-value width midpoints of 200$\gamma$, 220$\gamma$ and 311$\gamma$ is obtained and taken as the lattice constant ($a_0$) of $\gamma$ of the material by extrapolating $\theta$ at 90° based on $(\cos^2\theta/\sin\theta)+(\cos^2\theta/\theta)$ in order to obtain the amount of $C\gamma_R$ from $a_0=3.572+0.033$ (% C).

The requirements of martensite which contributes to the improvement of moldability will be described next.

$$(3)\ 0.25 \leqq [\alpha 2/(\alpha 1+\gamma_R)] \leqq 0.60 \quad (3)$$

In the above expression (3), $\alpha 2$ is the space factor of martensite and ($\alpha 1+\gamma_R$) is the area fraction of the second phase structure.

The above expression (3) is determined from the viewpoint that what has a ratio of martensite to the second phase structure (martensite and $\gamma_R$) of 0.25 to 0.60 obtains a desired yield ratio reduction effect and improved moldability. As is already known, martensite is considered to reduce the yield ratio by increasing the moving dislocation density of a portion therearound. The above expression (3) is specified to obtain this function of martensite effectively.

In the above expression (4), the area fraction ($\alpha 1+\gamma_R$) of the second phase structure is measured by image-analyzing the about t/4 position of a steel material as described above.

The space factor ($\alpha 2$) of martensite is defined as being calculated from a difference between the area fraction ($\alpha 1+\gamma_R$) of the above second phase structure and $Vt\gamma_R$ specified by the above expression (1). The reason for use of $Vt\gamma_R$ [$\gamma_R$ (volume fraction) in a measurement specimen calculated by the saturation magnetization measurement method] for the calculation of the space factor ($\alpha 2$) of martensite is that a measurement value obtained by the saturation magnetization measurement method is considered to be the most effective as an index indicating the amount of $\gamma_R$ accurately.

When the value obtained from the above expression (3) is smaller than 0.25, the function of martensite cannot be obtained effectively, the yield ratio becomes high and desired moldability cannot be obtained. When the value obtained from the above expression (3) is larger than 0.60, hard martensite is formed and becomes a starting point of destruction, thereby making it impossible to obtain desired $\gamma_R$ and to develop the ductility improving function of $\gamma_R$ effectively. It is preferably 0.5 or less, more preferably 0.4 or less.

A description is subsequently given of the basic components forming the steel sheet of the present invention. The units of all the chemical components are mass %.

C: 0.05% to Less than 0.25%

C is an essential element which ensures the strength and $\gamma_R$ of the steel sheet. When the amount of C is smaller than 0.05%, after a hot rolled steel sheet is wound up or after a cold rolled steel sheet is annealed, the amount of $\gamma_R$ existent in the steel sheet becomes extremely small, thereby making it impossible to fully obtain the desired TRIP effect of $\gamma_R$. It is preferably 0.08% or more, more preferably 0.10% or more. When C is added in an amount of 0.25% or more, the strength and the formation of the second phase structure become excessive and the number of the starting points of destruction increases, whereby a desired local ductility effect is not obtained. It is preferably 0.20% or less, more preferably 0.15% or less.

Si: 0.5 to 3.5%

Si is an element which contributes to the formation of $\gamma_R$. When the amount of Si is smaller than 0.5%, predetermined $\gamma_R$ is not obtained and the TRIP effect of $\gamma_R$ is not fully obtained. The amount of Si is preferably 1.0% or more, more preferably 1.2% or more. When Si is added in an amount of more than 3.5%, cracking may occur and workability also deteriorates. It is preferably 3% or less, more preferably 2.5% or less, much more preferably 2.0% or less.

Mn: 0.7 to 4%

Mn is an element which contributes to the formation of $\gamma_R$ like Si. To develop this function effectively, Mn must be added in an amount of 0.7% or more. The amount of Mn is preferably 1.0% or more, more preferably 1.5% or more. When the amount is larger than 4%, the above effect is saturated and it is economically wasteful. It is preferably 3.0% or less, more preferably 2.0% or less.

The present invention basically contains the above components and the balance consists substantially of iron and impurities. Besides the above components, the following admissible components can be added in limits that do not impair the function of the present invention.

Ni: 2% or Less (not Including 0%) and/or Cu: 2% or Less (not Including 0%)

These elements are both austenite stabilizing elements and contribute to the formation of $\gamma_R$. To develop this function effectively, 0.1% or more (preferably 0.3% or more) of Ni and 0.1% or more (preferably 0.3% or more) of Cu are preferably added. When they are added excessively, cracking may occur. Therefore, it is recommended to set the upper limit of Ni to 2% (preferably 1%) and that of Cu to 2% (preferably 1%).

The above elements may be added alone or in combination.

Cr: 1.0% or Less (not Including 0%) and/or Mo: 1.0% or Less (not Including 0%)

These elements contribute to the improvement of strength. To develop this function effectively, 0.1% or more (preferably 0.2% or more) of Cr and 0.1% or more (preferably 0.2% or more) of Mo are preferably added. When Cr is added excessively, a carbide is formed and the formation of $\gamma_R$ lowers. When Mo is added excessively, strength becomes too high and cracking may occur. The upper limit of Cr is 1.0% (preferably 0.5%) and that of Mo is 1.0% (preferably 0.5%).

These elements may be added alone or in combination.

P: 0.3% or Less

P is an element which contributes to the improvement of strength by solid solution strengthening. To this end, it is recommended to add 0.05% or more (preferably 0.1% or more) of P. When more than 0.3% of P is added, strength becomes too high and workability deteriorates, thereby causing cracking. It is preferably 0.2% or less.

Al: 2% or Less

Al is an element which contributes to the removal of an acid. When the amount of Al is larger than 2.0%, cracking is caused by continuous casting. It is preferably 1.0% or less.

at Least one Selected from the Group Consisting of Ti, Nb and V: 0.1% or Less in Total These elements have a deposition promoting function. In order to develop this function effectively, it is recommended to add at least one (one or more) of the above elements in a total amount of 0.01% or more (preferably 0.05% or more). When the total amount of the above element(s) is larger than 0.1%, a carbide is formed and a desired amount of $\gamma_R$ cannot be obtained. It is preferably 0.08% or less.

A description is subsequently given of the process for producing the steel sheet of the present invention.

The process of the present invention is a process for producing the above high-strength steel sheet by hot rolling, optionally cold rolling and continuous annealing, which comprises the steps of:

(1) subjecting a slab containing the above components to solution treatment at 1, 270° C. or higher for 5 hours or more and hot rolling the slab after solution treatment into a steel sheet, and (2) subjecting the steel sheet to austempering to be wound up, after the hot rolled steel sheet is cooled to a bainite transformation range and maintained at that temperature range for 50 to 200 seconds.

A description is first given of (1) solution treatment before hot rolling and (2) austempering in hot rolling/continuous annealing which characterize the process of the present invention.

(1) Solution Treatment Before Hot Rolling

As described above, the most characteristic feature of the steel sheet of the present invention is that it contains a large amount of $\gamma_R$ having a predetermined C content in the ferrite particles. The above solution treatment is extremely important to obtain this structure. Although solution treatment is generally carried out before the curing of an age hardening alloy, it is not employed for the production of a TRIP steel sheet because it takes time, the production process becomes complicated by the addition of a new step and the production cost is boosted. However, the inventors of the present invention have found through their studies for the first time that when appropriate solution treatment is carried out before hot rolling, it is extremely useful as means of preventing the central segregation of Mn or the like. That is, "relatively stable $\gamma_R$" which is useful for the improvement of local elongation is formed and "martensite or relatively instable $\gamma_R$ which readily transforms into martensite near a yield point" which is useful for the reduction of the yield ratio can be ensured by the above solution treatment. As the result, a desired high-strength steel sheet having both ductility and moldability can be provided.

To develop this function effectively, it is important that the temperature and time of solution treatment be suitably controlled. In the present invention, solution treatment is carried out at 1,270° C. or higher for 5 hours or more. When the solution treatment temperature is lower than 1,270° C., a solubility curve cannot be reached and a desired effect cannot be obtained. When the solution treatment time is shorter than 5 hours, the dispersion time before the dissolved atoms are uniformly distributed becomes insufficient, whereby a desired effect cannot be obtained as well. The desired effect is obtained only when the temperature and time are suitably controlled. It is recommended to carry out solution treatment preferably at 1,300° C. or higher for 10 hours or more, more preferably at 1,350° C. or higher for 15 hours or more. The upper limits of the solution treatment temperature and time are not particularly limited from the viewpoint "desired relatively stable $\gamma_R$ is formed". A higher treatment temperature and a longer treatment time are more preferred. However, taking productivity and cost in consideration, it is recommended to carry out the treatment at 1, 430° C. or lower for 25 hours or less (preferably 1,400° C. or lower for 20 hours or less).

(2) Austempering in Hot Rolling/Continuous Annealing

In the present invention, it is important that austempering be suitably carried out in addition to the above solution treatment. Thereby, a desired structure can be suitably obtained.

Stated more specifically, (1) after hot rolling, cooling to a bainite transformation range is carried out and that temperature range is maintained for 50 to 200 seconds before winding, or (2) the same treatment may be carried out in hot rolling, optionally cold rolling, continuous annealing and cooling. Either one of the above treatments (1) and (2) may be employed but when both are employed, more excellent characteristic properties are obtained.

When the above austempering is carried out for shorter than 50 seconds, the concentration of C in $\gamma_R$ becomes insufficient and desired ductility cannot be ensured. The austempering time is preferably 60 seconds or more, more preferably 120 seconds or more. When the austempering time is longer than 200 seconds, the concentration of C in $\gamma_R$ proceeds too far, whereby martensite which contributes to moldability and instable $\gamma_R$ which readily transforms into martensite are not obtained, the yield ratio becomes high and moldability deteriorates though local transformability becomes excellent. The austempering time is preferably 190 seconds or less, more preferably 180 seconds or less.

The solution treatment and austempering which characterize the process of the present invention the most have been described above. Treatments other than these are not particularly limited and a process which is generally employed for a TRIP steel sheet can be suitably selected and carried out so that the function of the present invention can be developed effectively. As for a hot rolling step, for example, after hot rolling at $A_{r3}$ point or higher, the obtained steep plate is cooled at an average cooling rate of about 30° C./s and wound up at a temperature of about 500 to 600° C.

It is recommended to carry out cold rolling which is optionally carried out at a cold rolling rate of about 30 to 70%. Further, as for continuous annealing, it is recommended to cool at an average cooling rate of 5° C./s or more and carry out austempering at a bainite transformation range. The present invention is in no way limited to these methods.

The present invention will be described in detail based on the following examples. The following examples do not limit the present invention and changes and modifications may be made in the invention without departing from the spirit and scope thereof.

EXAMPLES

Example 1

Studies on Composition of Components, Existence of Solution Treatment and Austempering Time A steel piece containing chemical components shown in Table 1 (unit in Table 1 is mass %) was continuously cast, and the obtained slab was subjected to solution treatment at 1,280° C. for 10 hours, heated at 1,200° C., finish rolled at 900° C., cooled and wound up at about 500° C. to obtain a 3 mm-thick hot rolled steel sheet. The hot rolled steel sheet was cold rolled to a thickness of 1.2 mm. The cold rolled steel sheet was subjected to recrystallization annealing (continuous annealing) in a continuous annealing line (CAL) in accordance with a commonly used method and cooled to a bainite transformation range. By changing the heat retention time (austempering time) at that temperature range to 30 to 300 seconds, various steel sheets were obtained.

For comparison, hot rolling, cold rolling and recrystallization annealing were carried out in the same manner as described above except that the above solution treatment was not carried out (austempering time was 180 seconds, 300 seconds and 600 seconds) to obtain steel sheets.

The thus obtained steel sheets were measured for their tensile strength (TS), local elongation (l-EL), uniform elongation (u-EL), total elongation (T-EL) and yield power (YP) using JIS No. 5 tensile test specimens. In the present invention, steel sheets which satisfied all the following requirements (1) to (3) were evaluated as "examples of the present invention".

(1) strength x local elongation: [TS (MPa)]×[l-EL (%)] ≧5500

(2) ratio of local elongation to total elongation [(l-EL)/(t-EL)]≧0.25

(3) yield ratio (YR=YP/TS)≦65%

The area fraction of the second phase structure, the area fraction ($SF\gamma_R/Vt\gamma_R$) of $\gamma_R$ within the mother phase ferrite particle, the space factor [$\alpha 2/(\alpha 1+\gamma_R)$] of martensite and $C\gamma_R$ in each steel sheet were measured in accordance with the above methods and the total volume fraction ($Vt\gamma_R$) of $\gamma_R$ was measured by the following method.

[Measurement of Total Volume Fraction ($Vt\gamma_R$) of $\gamma_R$]

Details of the saturation magnetization measurement have been described above. More specifically, a measurement specimen measuring 1.2 mm (thickness)×4 mm (width)×30 mm (length) (prepared by cutting out three steel pieces from a section from both end portions to a center portion of the obtained steel sheet by a wire cutter with the greatest care not to provide distortion and putting them together to obtain a 3.6 mm-thick laminate) was used. The gap between electrodes was 30 mm, application magnetization was 5,000 Oe (oersted) at room temperature, and the both pole maximum magnetization average value of a hysteresis loop was taken as the amount of saturation magnetization. After the amount of saturation magnetization (I) in the above measurement specimen was measured by the above method, the specimen was austempered at 420° C. for 15 hours to measure the amount of saturation magnetization (Is) in the specimen when $\gamma_R$ was 0 vol % so as to obtain the volume fraction ($Vt\gamma_R$) of $\gamma_R$ by inserting them into the following expression (A).

$$\gamma_R \text{ (vol \%)}=(1-I/Is)\times 100 \quad \text{(A)}$$

The results are shown in Table 2.

TABLE 1

| Type of steel | Chemical components (mass %) C | Si | Mn | P or S | Al |
|---|---|---|---|---|---|
| A | 0.1 | 1.2 | 1.5 | 0.01 | 0.03 |
| B | 0.03 | 1.3 | 1.7 | 0.01 | 0.03 |
| C | 0.3 | 1.1 | 1.4 | 0.01 | 0.03 |
| D | 0.1 | 0.2 | 1.5 | 0.01 | 0.03 |
| E | 0.1 | 4.0 | 1.5 | 0.01 | 0.03 |
| F | 0.1 | 0.7 | 3.0 | 0.01 | 0.03 |

TABLE 2

| Specimen No | Steel No | Solution treatment | Austempering time | Mechanical properties YP MPa | TS MPa | t-EL (%) | u-EL (%) | l-EL (%) | TSx l-EL | l-EL/t-EL | YR | Structure Second phase (%) | $Vt\gamma_R$ (%) | $SF\gamma_R$ (%) | $SF\gamma_R/NT\gamma_R$ | α2 Second phase | $C_{\gamma R}$ (%) |
|---|---|---|---|---|---|---|---|---|---|---|---|---|---|---|---|---|---|
| 1 | A | done | 30 | 300 | 630 | 29.0 | 22.5 | 6.5 | 4095 | 0.22 | 47.6 | 12.0 | 3.5 | 2.5 | 0.71 | 0.71 | 0.85 |
| 2 | A | done | 180 | 400 | 630 | 33.5 | 24.3 | 9.2 | 5796 | 0.27 | 63.5 | 12.0 | 8.7 | 6.2 | 0.71 | 0.28 | 1.15 |
| 3 | A | done | 300 | 450 | 610 | 32.0 | 17.1 | 14.9 | 9089 | 0.47 | 73.8 | 10.0 | 8.0 | 6.0 | 0.75 | 0.20 | 1.25 |
| 4 | A | — | 180 | 300 | 590 | 30.0 | 23.0 | 7.0 | 4130 | 0.23 | 50.8 | 12.0 | 4.6 | 1.6 | 0.35 | 0.62 | 0.9 |

TABLE 2-continued

| Specimen No | Steel No | Solution treatment | Austempering time | Mechanical properties YP MPa | TS MPa | t-EL (%) | u-EL (%) | l-EL (%) | TSx l-EL | l-EL/ t-EL | YR | Structure Second phase (%) | $Vt\gamma_R$ (%) | $SF\gamma_R$ (%) | $SF\gamma_R$ $NT\gamma_R$ | α2 Second phase | $C_{\gamma R}$ (%) |
|---|---|---|---|---|---|---|---|---|---|---|---|---|---|---|---|---|---|
| 5 | A | — | 300 | 330 | 590 | 35.0 | 25.7 | 9.3 | 5487 | 0.27 | 55.9 | 12.0 | 8.4 | 4.7 | 0.56 | 0.30 | 1.15 |
| 6 | A | — | 600 | 465 | 590 | 34.0 | 18.0 | 16.0 | 9440 | 0.47 | 78.8 | 9.5 | 8.1 | 4.7 | 0.58 | 0.15 | 1.23 |
| 7 | B | done | 180 | 343 | 549 | 30.0 | 22.3 | 7.7 | 4227 | 0.26 | 62.5 | 5.9 | 3.0 | 1.9 | 0.63 | 0.49 | 1 |
| 8 | C | done | 30 | 400 | 840 | 15.0 | 11.7 | 3.3 | 2772 | 0.22 | 47.6 | 35.0 | 4.5 | 3.0 | 0.67 | 0.87 | 0.85 |
| 9 | C | done | 180 | 510 | 840 | 19.3 | 13.1 | 5.9 | 4956 | 0.31 | 60.7 | 35.0 | 25.6 | 18.6 | 0.73 | 0.27 | 1.17 |
| 10 | C | done | 300 | 630 | 820 | 17.0 | 9.6 | 7.4 | 6068 | 0.44 | 76.8 | 29.0 | 23.1 | 18.1 | 0.78 | 0.20 | 1.3 |
| 11 | C | — | 180 | 480 | 810 | 16.0 | 12.3 | 3.7 | 2997 | 0.23 | 59.3 | 35.0 | 13.5 | 4.5 | 0.33 | 0.61 | 0.9 |
| 12 | C | — | 300 | 490 | 810 | 22.0 | 15.9 | 6.1 | 4941 | 0.28 | 60.5 | 35.0 | 25.0 | 13.5 | 0.54 | 0.29 | 1.17 |
| 13 | C | — | 600 | 650 | 810 | 21.0 | 12.0 | 9.0 | 7290 | 0.43 | 80.2 | 28.0 | 24.0 | 13.5 | 0.56 | 0.14 | 1.25 |
| 14 | D | done | 180 | 395 | 620 | 19.5 | 14.0 | 5.5 | 3410 | 0.28 | 63.7 | 10.7 | 4.5 | 3.6 | 0.80 | 0.58 | 1.1 |
| 15 | E | done | 180 | cracked by hot rolling | | | | | | | | | | | | | |
| 16 | F | done | 30 | 310 | 670 | 26.9 | 20.9 | 6.0 | 4020 | 0.22 | 46.3 | 12.3 | 3.7 | 2.8 | 0.76 | 0.70 | 0.85 |
| 17 | F | done | 180 | 420 | 670 | 31.8 | 22.8 | 9.0 | 6030 | 0.28 | 62.7 | 12.3 | 8.7 | 6.9 | 0.79 | 0.29 | 1.15 |
| 18 | F | done | 300 | 495 | 630 | 31.0 | 17.0 | 14.0 | 8820 | 0.45 | 78.6 | 10.0 | 8.0 | 6.0 | 0.75 | 0.20 | 1.25 |
| 19 | F | — | 180 | 355 | 605 | 29.0 | 22.7 | 6.3 | 3812 | 0.22 | 58.7 | 12.3 | 6.0 | 2.7 | 0.45 | 0.51 | 0.9 |
| 20 | F | — | 300 | 365 | 605 | 33.5 | 24.5 | 9.0 | 5445 | 0.27 | 60.3 | 12.3 | 8.0 | 4.0 | 0.50 | 0.35 | 1.15 |
| 21 | F | — | 600 | 510 | 605 | 33.0 | 17.5 | 15.5 | 9378 | 0.47 | 84.3 | 9.5 | 8.3 | 4.6 | 0.55 | 0.13 | 1.23 |

The following can be observed from the above results.

Nos. 1 to 6 (type of steel in Table 1 is A) and Nos. 16 to 21 (type of steel in Table 1 is F) in Table 2 are examples in which a slab having the composition of the present invention was used and solution treatment and austempering time were changed.

Out of these, Nos. 2 and 17 are examples in which predetermined solution treatment and austempering were carried out, and high-strength steel sheets having all the above characteristic properties (1) to (3) were obtained.

In contrast to these, Nos. 1 and 16 are examples in which instable $\gamma_R$ which readily transforms into martensite and martensite were formed in large quantities due to a short austempering time (30 seconds) though predetermined solution treatment was carried out, desired elongation was not obtained as the instable $\gamma_R$ and martensite became the starting points of destruction, and balance between strength and local ductility was bad.

Nos. 3 and 18 are examples in which predetermined solution treatment was carried out, austempering was carried out for 300 seconds, extremely stable $\gamma_R$ was formed, and balance between strength and local ductility was excellent but moldability was poor due to high $\gamma_R$ resulted by the formation of a small amount of martensite.

Nos. 4 and 19 are examples in which solution treatment was not carried out at all and only austempering was carried out. However, central segregation could not be eliminated and instable $\gamma_R$ which readily transforms into martensite and martensite were formed in large quantities and became the starting points of destruction, thereby making it impossible to obtain desired elongation and good balance between strength and local ductility.

Nos. 5 and 20 are examples in which solution treatment was not carried out at all and austempering was carried out for 300 seconds. The amount of extremely stable $\gamma_R$ which contributes to uniform transformation was small and balance between strength and local ductility was bad.

Nos. 6 and 21 are examples in which solution treatment was not carried out at all and austempering was carried out for 600 seconds. Extremely stable $\gamma_R$ was formed and balance between strength and local ductility was excellent but moldability was poor due to high $\gamma_R$ resulted by the formation of a small amount of martensite.

No. 7 is an example in which B type steel in Table 1 having a low C content was used and balance between strength and local ductility was bad.

Nos. 8 to 13 are examples in which C type steel having a high C content was used and solution treatment and austempering time were changed.

In No. 8 out of these, predetermined solution treatment was carried out but instable $\gamma_R$ which readily transforms into martensite and martensite were formed in large quantities due to a short austempering time (30 seconds), desired elongation was not obtained as they became the starting points of destruction, and balance between strength and local ductility was bad.

In No. 9, predetermined solution treatment and austempering were carried out but the formation of a soft ferrite phase was rare and a large amount of second phase hard martensite was formed due to a high content of C and became the starting point of destruction, and balance between strength and local ductility was bad.

In No. 10, predetermined solution treatment was carried out and austempering was carried out for 300 seconds, extremely stable $\gamma_R$ was formed, balance between strength and local ductility was good but moldability was poor due to high $\gamma_R$ resulted by the formation of a small amount of martensite.

In No. 11, solution treatment was not carried out at all, instable $\gamma_R$ which readily transforms into martensite and martensite were formed in large quantities due to the occurrence of central segregation and became the starting points of destruction, thereby making it impossible to obtain desired elongation and good balance between strength and local ductility.

In No. 12, solution treatment was not carried out at all, austempering was carried out for 300 seconds, the amount of extremely stable $\gamma_R$ which contributes to uniform transformation was small, and balance between strength and local ductility was bad.

In No. 13, solution treatment was not carried out at al, austempering was carried out for 600 seconds, extremely stable $\gamma_R$ was formed, and balance between strength and local ductility was extremely excellent but moldability was poor due to high YR resulted by the formation of a small amount of martensite.

In No. 14, type D steel having a low Si content was used. A desired amount of $\gamma_R$ was not obtained, and balance between strength and local ductility was bad.

In No. 15, type E steel having a high Si content was used. Cracking was caused by hot rolling.

What is claimed is:

1. A high-strength steel sheet having excellent workability comprising:

0.06 to 0.25% by mass of carbon;

0.5 to 3.5% by mass of Si; and 0.7 to 4% by mass of Mn, wherein mother structure of said steel sheet is ferrite, second phase structure of said steel sheet comprises martensite and the residual austenite and said second phase structure ($\alpha 1+\gamma_R$) has an area fraction of 25% or less based on the total structure when it is measured by image analysis, and wherein said steel sheet satisfies the following requirements (1) to (3):

(1) the volume fraction ($Vt\gamma_R$) of said residual austenite is 5% or more when a measurement specimen of said residual austenite is measured by saturation magnetization measurement, (2) the ratio ($SF\gamma_R/Vt\gamma_R$) of the area fraction ($SF\gamma_R$) of said residual austenite within the ferrite particle to $Vt\gamma_R$ is 0.65 or more when the area fraction is measured by FE-SEM/EBSP, and (3) the ratio [$\alpha 2/(\alpha 1+\gamma_R)$] of the space factor ($\alpha 2$) of said martensite to the second phase structure ($\alpha 1+\gamma_R$) satisfies the following expression:

$$0.25 \leqq [\alpha 2/(\alpha 1+\gamma_R)] \leqq 0.60,$$

wherein the space factor ($\alpha 2$) is calculated from a difference between the second phase structure ($\alpha 1+\gamma_R$) and the residual austenite ($Vt\gamma_R$).

2. A high-strength steel sheet having excellent workability comprising:

0.06 to 0.25% by mass of carbon;

0.5 to 3.5% by mass of Si; and 0.7 to 4% by mass of Mn, wherein mother structure of said steel sheet is ferrite, second phase structure of said steel sheet comprises martensite and the residual austenite and said second phase structure ($\alpha 1+\gamma_R$) has an area fraction of 25% or less based on the total structure when it is measured by image analysis, and wherein said steel sheet satisfies the following requirements (1), (4) and (3):

(1) the volume fraction ($Vt\gamma_R$) of said residual austenite is 5% or more when a measurement specimen of said residual austenite is measured by saturation magnetization measurement, (4) the average C content of said residual austenite is 0.95 to 1.15% by mass, and (3) the ratio [$\alpha 2/(\alpha 1+\gamma_R)$] of the space factor ($\alpha 2$) of said martensite to the second phase structure ($\alpha 1+\gamma_R$) satisfies the following expression:

$$0.25 \leqq [\alpha 2/(\alpha 1+\gamma_R)] \leqq 0.60,$$

wherein the space factor ($\alpha 2$) is calculated from a difference between the second phase structure ($\alpha 1+\gamma_R$) and the residual austenite ($Vt\gamma_R$).

3. A process for producing a high-strength steel sheet, the process comprising:

subjecting a steel slab, which comprises 0.06 to 0.25% by mass of Si, and 0.5 to 3.5% by mass of Si; and 0.7 to 4% by mass of Mn, to solution treatment at 1,270° C. or higher for 5 hours or more;

hot rolling the slab into a steel sheet; and subjecting the steel sheet to austempering by cooling the steel sheet after the hot rolling to the bainite transformation range and maintaining the steel sheet within that temperature range for 50 to 200 seconds.

4. The process according to claim 3, further comprising cold rolling the steel sheet after the austempering.

5. The process according to claim 4, further comprising subjecting the cold rolled steel sheet to continuous annealing.

6. The steel sheet according to claim 2, wherein the residual austenite having the average C content of 0.95 to 1.15% by mass is within each ferrite particle.

* * * * *